United States Patent [19]

Adams

[11] 3,945,073

[45] Mar. 23, 1976

[54] MACHINES FOR PUNCHING AND FOR CLOSING WIRE BINDING ELEMENTS

[75] Inventor: Sidney George William Adams, Walton-on-Thames, England

[73] Assignee: James Burn Bindings Limited, England

[22] Filed: Jan. 24, 1974

[21] Appl. No.: 436,213

[30] Foreign Application Priority Data

Jan. 31, 1973 United Kingdom ..... 4935/73

[52] U.S. Cl. ..... 11/1 A; 83/618; 227/76

[51] Int. Cl.[2] ..... B42B 5/10

[58] Field of Search ..... 29/237.5; 83/618, 590, 83/684, 687, 689; 227/76; 11/1 A

[56] References Cited

UNITED STATES PATENTS

| | | | |
|---|---|---|---|
| 848,869 | 4/1907 | Upton | 83/590 X |
| 3,060,780 | 10/1962 | Stukens | 83/618 X |
| 3,073,199 | 1/1963 | Yerkes | 83/590 X |

*Primary Examiner*—Al Lawrence Smith
*Assistant Examiner*—J. C. Peters
*Attorney, Agent, or Firm*—Wood, Herron & Evans

[57] ABSTRACT

A machine for punching and subsequently binding packets of sheets to book form with wire binding elements comprises a punch and a press connected to, and driven from a common operating member through a mechanical drive, the mechanical drive being so arranged as to move the punch through a shorter distance and at a higher mechanical advantage than the press.

4 Claims, 3 Drawing Figures

MACHINES FOR PUNCHING AND FOR CLOSING WIRE BINDING ELEMENTS

This invention relates to machines for punching and subsequently binding packets of sheets to book form with wire binding elements each formed from a length of metal wire bent to form a series of curved hirpin-shaped prongs on which the sheets are impaled and which are brought to ring shape by pressing their closed ends or "points" into the vicinity of their open ends or "roots". Such binding elements will be referred to herein as a Burn Bindings Wire element.

It is desirable for certain installations to use a machine which punches the perforations in the packet of sheets and also subsequently acts to press the binding elements into a closed position passing through the perforations.

This however creates certain problems in that one requires a fairly short stroke with maximum power for punching the perforations and a rather longer stroke for operating the press so that fairly large binding elements can be employed. Machines having a variable stroke can of course be produced but these tend to be complicated and expensive.

In accordance with this invention a combined paper punching and wire binding element closing machine comprises a punch and a press driven from a common power source through a mechanical drive which acts to move the punch member through a smaller distance and at a higher mechanical advantage that the press.

If the machine is to be operated manually it is provided with an operating lever or handle movement of which may for example act to rotate a relatively small diameter pinion to drive the punch downwardly it may act to move the press a closing direction, the press being connected to the handle by means of a link. The drive may alternatively be transmitted through a rack or pinion system or eccentrics from the operating lever or handle.

The invention will now be further described by way of example with reference to the drawing accompanying the complete specification in which.

Figure 1:
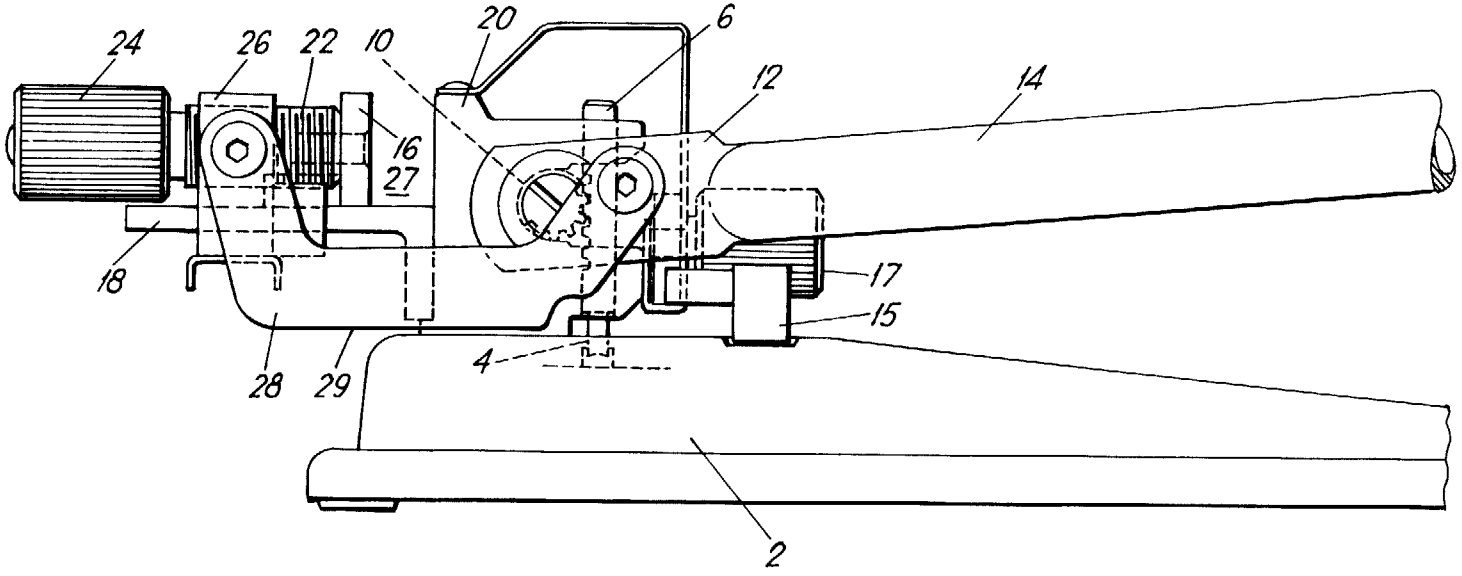
FIG. 1 is a side elevation of one embodiment of a machine in accordance with the invention.
Figure 2:
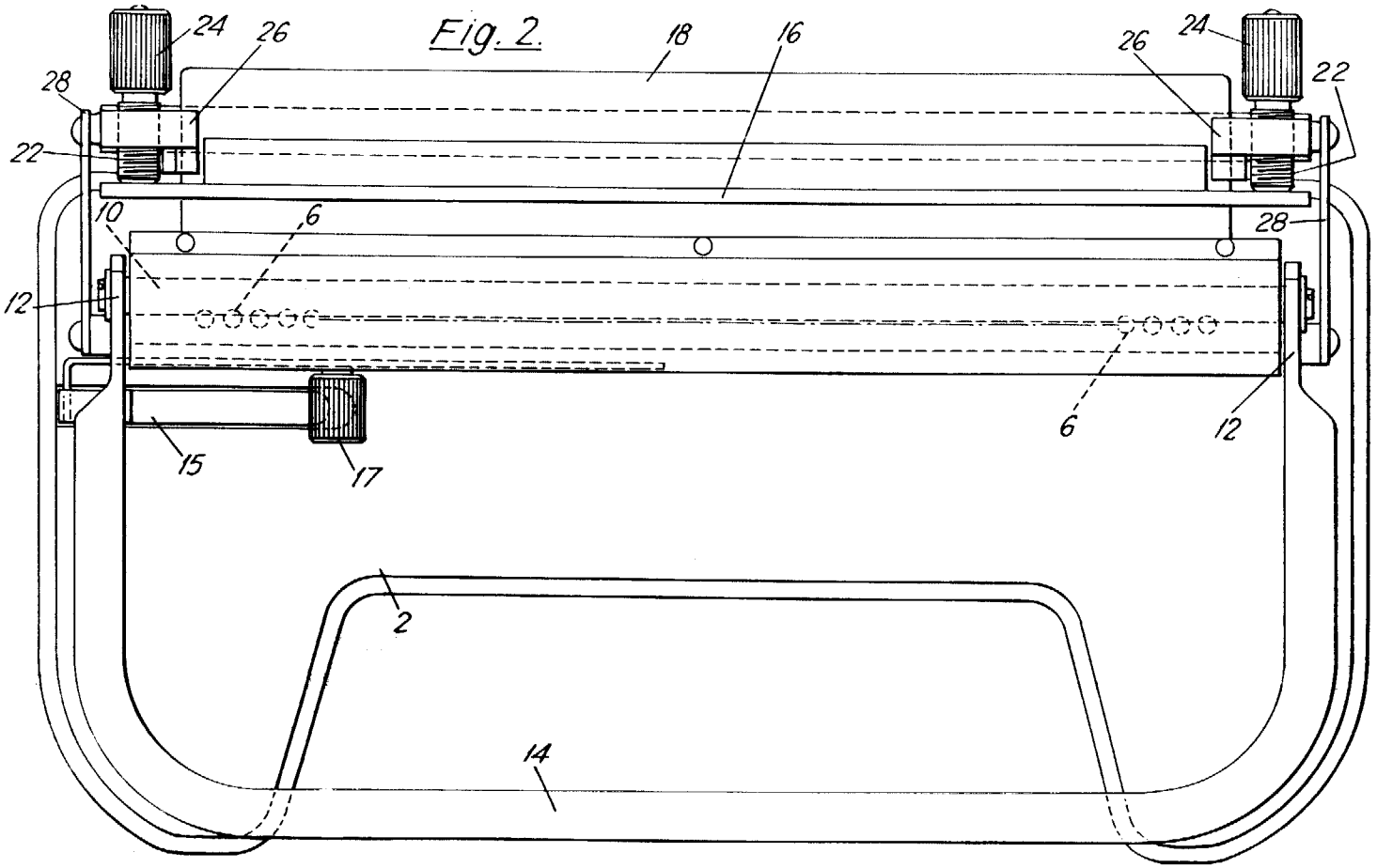
FIG. 2 is a plan view of the machine.
Figure 3:
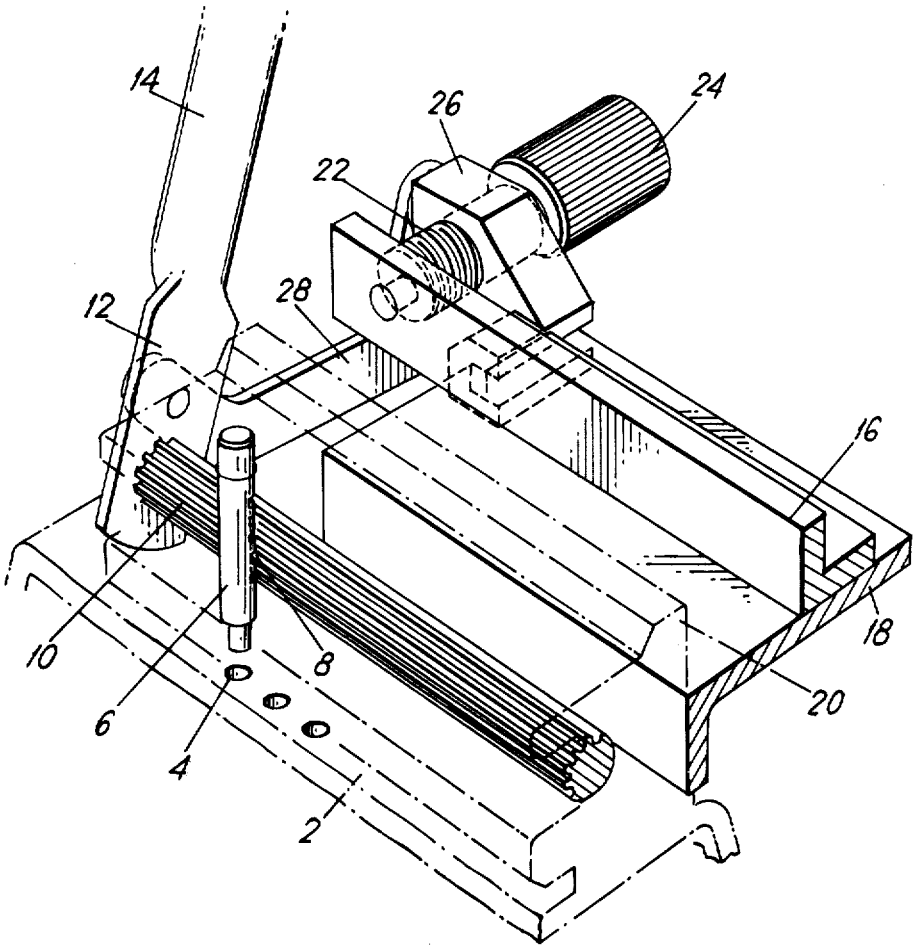
FIG. 3 is a perspective detail view of the drive mechanism.

Referring to FIGS. 1 and 2 the machine comprises a base 2 formed with a series of holes 4 into which a series of punches 6 are arranged to driven. Each punch 6 is formed with a rack 8 which engages the teeth of a pinion rod 10 extending along the machine and which engages the racks of all the punch rods.

The two ends of the pinion rod 10 are fixed to the ends 12 of a U-shaped operating handle 14 arcuate movement of the handle causing rotation of the pinion and downward movement of the punches. Thus if a packet of sheets of paper (not shown) is placed on the base 2 with the handle 14 in its vertical position, then on movement of the handle to its horizontal position (see FIG. 1) the punches are driven down through the packet to punch a series of holes in the packet. An adjustable stop 15, which is moveable across the machine, is provided in order to accomodate and guide the sheets of paper. The stop 15 is held in the position required according to the size of paper, by means of a locking knob 17. As the pinion rod 10 is of relatively small diameter and the distance of the cross member of the handle fairly well spaced from the ends 12 a relatively large force may be applied to the punches to drive them a short distance with a high mechanical advantage.

The handle is moved back to its vertical position so enabling the packet of sheets to be removed.

In order to bind that, or another packet, a strip of Burn Bindings Wire element is placed with its prongs extending through the punched holes and is then placed in a closing press forming part of the machine. This press comprises a plate 16 slidably mounted on a platform 18 extending out from the base 2. The plate is carried by a rod 22 at each end of the machine. The other end of each rod is connected to an adjusting knob 24 through a slide 26. The slide 26 is linked to the end 12 of the handle 14, at each end of the machine, through a link 28. Movement of the handle to operate the punches also, through the link 28, pulls the plate 16 towards frame 20, which movement acts to squeeze the elements of the Wire-O binding element (not shown) located between the plate 16 and frame 20, therefore causing the prongs to close through the punched holes to bind the packet of sheets.

The link 28 is U-shaped so that slot 27 formed between the plate 16 and frame 20 is open ended, thus enabling packets of sheets of paper, larger in size than the width of the machine, to be bound. This also allows the packets to be slid in from the side of the machine. Link 28 has a flat bottom or stop area 29 which contacts the box 2 when the handle 14 is brought into its horizontal position, therefore preventing any further downward movement of the handle 14.

The size of the press and hence the size of elements receivable may be adjusted by the nuts 24 which engage the screwed outer end of the rod 24, adjustment of the nut moving the plate 16 relatively to the frame 20.

A stroke of the operating handle causes the rods 22 and hence the plate 16 to move through a longer stroke than the punches 6 but at a smaller mechanical advantage.

Instead of the drive being transmitted to the press through a link, it would be transmitted through a rack and pinion. The press is therefore attached to a member having a rack which meshes with a relatively large diameter pinion mounted at each end of the pinion rod, that meshes with the rack of the punch.

A further alternative is to replace both racks and pinions with levers. In this case the relatively smaller diameter pinion is replaced with a lever which extends out from a rod, and which engages with a groove, which replaces the rack, formed in the punch. The relatively larger diameter pinion is replaced by a lever which extends outwards from a sleeve fitted over each end of the rod and which engages in a groove formed in the member attached to the press.

Instead of being manually operably the machine may be power driven.

I claim:

1. A machine for punching and, subsequently, binding, a packet of sheets into book form, said machine being adapted for use with a wire binding element of the type that must be compressed from an open loop configuration to a closed loop configuration through a series of perforations in said packet of sheets, said machine comprising a punch that includes a series of punches for forming a series of perforations in said packet of sheets, a press for binding said packet of sheets together with said wire binding element, said press including a movable press plate adapted to compress said wire binding elements against a fixed press plate from open loop to closed loop configuration through the perforations in said packet, a first mechanical drive connected with said punch, said first mechanical drive being adapted to move said punches through a lesser distance at a greater mechanical advantage than said press plate is so moved, said first mechanical drive comprising a pinion connected to said operating member, and said pinion meshing with a rack formed on each of said punches, a second mechanical drive connected with said press, said second mechanical drive being adapted to move said press plate through a greater distance at a lesser mechanical advantage than said punches are so moved, said second machanical drive comprising a link connecting said press plate and said operating member, and an operating member connected with said first and second mechanical drives for operating said mechanical drives when desired, both said punch and said press being operated through that one operating member, said punches being particularly driven to perforate a packet of sheets within said punch, and said press plate being moved in a compressing direction to close a wire binding element within said press, as said operating member is activated.

2. A machine as set forth in claim 1, said link including a flatted portion adapted to contact a stop surface on said machine, contact of said link with said stop surface limiting the operational movement of said operating member.

3. A machine as set forth in claim 1 including means for adjusting the stroke of said press plate.

4. A machine as set forth in claim 1 wherein said operating member is a handle adapted to be gripped manually.

* * * * *